US005901597A

United States Patent [19]

Müller et al.

[11] Patent Number: 5,901,597

[45] Date of Patent: May 11, 1999

[54] METHOD OF OPERATING A ROLL STAND ARRANGEMENT

[75] Inventors: Hubert Müller, Grevenbroich; Ulrich Svejkovsky, Wuppertal, both of Germany

[73] Assignee: SMS Schloemann-Siemag Aktiengesellschaft, Düsseldorf, Germany

[21] Appl. No.: 08/852,216

[22] Filed: May 7, 1997

[30] Foreign Application Priority Data

May 8, 1996 [DE] Germany ..... 196 18 437

[51] Int. Cl.[6] ..... B21B 41/06; B21B 41/04; B21B 13/08

[52] U.S. Cl. ..... 72/229; 72/228; 72/234

[58] Field of Search ..... 72/224, 225, 226, 72/228, 229, 234, 365.2, 366.2

[56] References Cited

U.S. PATENT DOCUMENTS 4,550,582 11/1985 Ehiro et al. ..... 72/234

5,121,622 6/1992 Kosak et al. ..... 72/225

5,664,452 9/1997 Engel et al. ..... 72/229

*Primary Examiner*—Joseph J. Hail, III

*Assistant Examiner*—Rodney Butler

*Attorney, Agent, or Firm*—Friedrich Kueffner

[57] ABSTRACT

A method of operating a roll stand arrangement composed of one or more roughing stands and a compact rolling group arranged downstream of the roughing stands and transversely offset relative to the roughing stands. The compact rolling group is connected to the roughing stands through roller conveyors and a transverse conveying unit. The compact rolling group is composed of a first and a second universal stand or two-high stand and an intermediate upsetting stand between the first and second stands. Preliminary sections arriving from a continuous casting plant are supplied directly or after intermediate storage to the roll stand arrangement. The rolling stock strand which has been rolled in the roughing stands is supplied optionally from a first entry side or a second entry side into the compact rolling group in dependence on the number of passes required by the respective rolling program.

5 Claims, 1 Drawing Sheet

METHOD OF OPERATING A ROLL STAND ARRANGEMENT

BACKGROUND OF THE INVENTION

1. Field of the Invention

The present invention relates to a method of operating a roll stand arrangement which is composed of one or more roughing stands and a compact rolling group arranged downstream of the roughing stands and transversely offset relative to the roughing stands. The compact rolling group is connected to the roughing stands through roller conveyors and a transverse conveying unit. The compact rolling group is composed of a first and a second universal stand or two-high stands and an intermediate upsetting stand between the first and second stands. Preliminary sections arriving from a continuous casting plant are supplied directly or after intermediate storage to the roll stand arrangement.

2. Description of the Related Art

As a rule, roll stand arrangements of the above-described type are operated in such a way that the strand of rolling stock to be rolled in the roughing stands is deformed by rolling in the compact rolling group by carrying out an odd number of passes. It has also already been proposed to achieve an even number of passes through the compact rolling group by arranging the roughing stands relative to the continuous casting plant in such a way that the preliminary section is introduced into the roughing stands in a direction opposite the rolling direction and the strand is introduced with its rearward end first into the compact rolling grove.

Accordingly, in the compact rolling groups of the above-described type which include two universal stands, it is necessary, for four principal passes, to carry out two additional passes. On the other hand, if only one pass or two passes more than one pass are required, the compact rolling group is occupied for an unnecessary long time. In modern rolling mills of this type, the adjustment of the occupation of the compact rolling group to the output of the continuous casting plant producing the preliminary section of the rolling stock strand represents an essential factor with respect to the total output of the plant. This adjustment must be carried out in such a way that the output of the roll stand arrangement is always to a small extent greater than that of the continuous casting plant. This adjustment makes it possible in the total plant to avoid a cold intermediate storage between the continuous casting plant and the roll stand arrangement.

SUMMARY OF THE INVENTION

Starting from the finding that the roughing stands arranged in front of the compact rolling group, usually a vertical stand and/or a horizontal upsetting stand for the formation of the strand, require substantially less rolling time than the subsequent compact rolling group, and that, therefore, primarily the output of the compact rolling group must be increased in order to meet the above-described output requirements, it is the primary object of the present invention to increase the output of the compact rolling group by providing the possibility of determining in an optimum manner the number and sequence of passes of the strand in dependence on the actually required number of deforming passes in the compact rolling group.

In accordance with the present invention, the rolling stock strand which has been rolled in the roughing stands is supplied optionally from a first entry side or a second entry side into the compact rolling group in dependence on the number of passes required by the respective rolling program.

Accordingly, while in the known methods in which the strand is introduced always from one side of the compact rolling group, the selection of the number of passes was predetermined and, for example, when it was required to carry out an additional pass, four additional passes in the form of rolling passes or dummy passes were unavoidable, the method according to the present invention makes it possible to select an optimum number of passes corresponding to the actual deforming requirements and, thus, to achieve significant output increases of the compact rolling group.

In accordance with the present invention, the roll stand arrangement may be configured in such a way that a second transverse conveying unit is arranged following the second universal stand or two-high stand, wherein the second transverse conveying unit is connected to the first transverse conveying unit through an extension of the connecting roller conveyor for conveying the strand to the first transverse conveying unit from the roughing stands.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
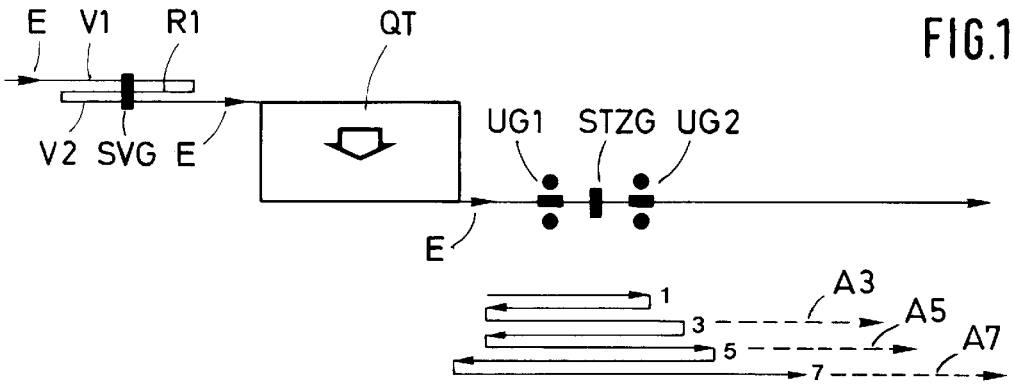
FIG. 1 is a schematic top view of a rolling mill and a pass sequence diagram.

As illustrated in FIG. 1, in a known rolling mill, the preliminary section, not shown, arriving from a continuous casting plant, also not shown, in the direction of arrow E is introduced with a roughing pass V1 into the roughing stand SVG, which may also be replaced by several roughing stands, the preliminary section is deformed in a subsequent reversing pass R1 and another roughing pass V2, and is then conveyed in the direction of arrow E onto the transverse conveying unit QT and is further conveyed, after having been transversely conveyed, into the compact rolling group composed of the universal stand UG1, the intermediate upsetting stand STZG and the universal stand UG2, wherein it is possible in the compact rolling group to carry out, with a pass 1, the subsequent reversing pass and then a pass 3, i.e., after altogether three passes, a rolling procedure with the strand emerging in the direction of arrow 3 indicated by broken lines. If the strand is to be deformed further by rolling, this can be carried out after another reversing pass and the subsequent pass 5 in the direction of arrow A5, also shown in broken lines, and after a further reversing pass and the pass 7, in the direction of arrow A7, also shown in broken lines.

Figure 2:
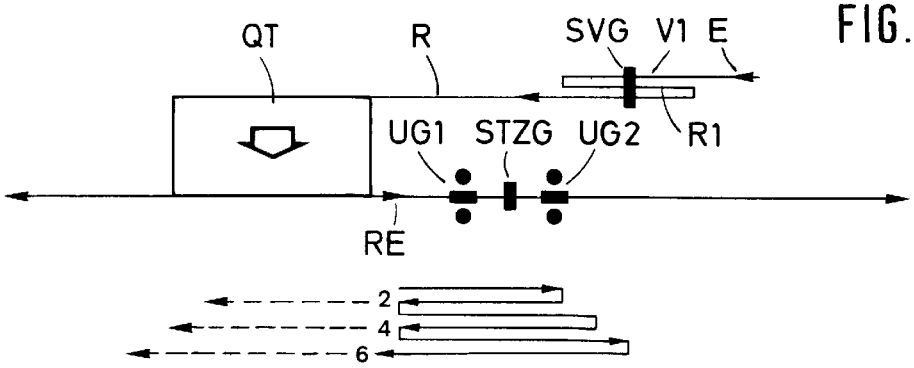
FIG. 2 shows another embodiment of a rolling mill with pass sequence diagram.

In the rolling mill illustrated in FIG. 2 which is also known in the art, the deformation of the rolling stock entering the roughing stand group SVG in the direction of arrow E takes place in the same manner as described above in connection with the embodiment of FIG. 1. The embodiment of FIG. 2 differs from the embodiment of FIG. 1 in that the rolling stock strand which has been deformed in the roughing group is conveyed on the roller conveyor R at a distance from and parallel to the compact rolling group UG1, STZG, UG2 to the transverse conveying unit QT on which the strand is transversely displaced and is then introduced into the compact rolling group in the direction RE which is opposite the direction of arrow E, and is then finish rolled either with one pass and a subsequent reversing pass, i.e., altogether two passes, or with an additional pass and a subsequent reversing pass, i.e., four passes, or yet another subsequent pass and a reversing pass, i.e., altogether six passes.

Accordingly, in the embodiment of FIG. 1, the odd-numbered pass sequences 3, 5, 7 were possible for finish rolling, while the even-numbered pass sequences 2, 4, 6 were possible in the embodiment of FIG. 2.

Figure 3:
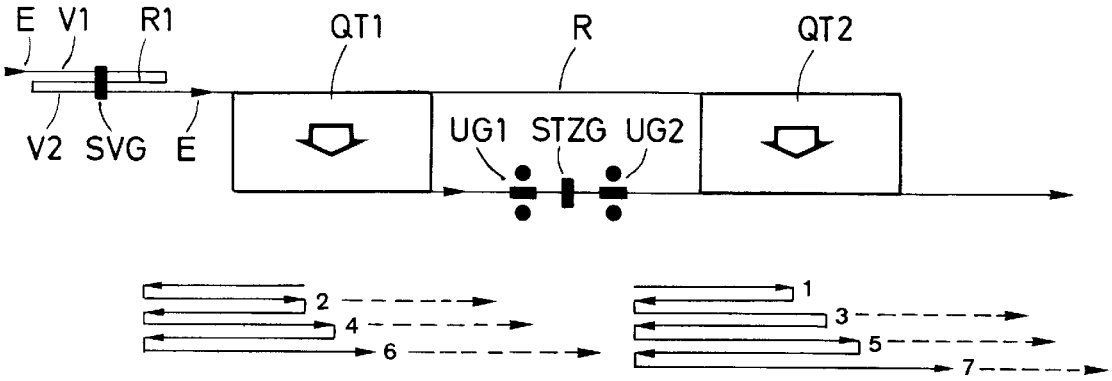
FIG. 3 shows an embodiment of a rolling mill with pass sequence diagram according to the present invention.

In the embodiment of the rolling mill according to the present invention shown in FIG. 3, in addition to the arrangement of the roughing group SVG, the compact rolling group UG1, STZG, UG2 and the transverse conveying unit QT1 arranged between and transversely offset relative to the roughing group SVG, a roller conveyor R extending parallel past the compact rolling group UG1, STZG, UG2 is arranged following the entry of the transverse conveying unit QT1 and a second transverse conveying unit QT2 is provided following the roller conveyor R. This configuration now makes it possible optionally to carry out the odd number of pass sequences according to FIG. 1, or the even number of pass sequences according to FIG. 2. In the first case, the strand deformed in the roughing group is conveyed to the compact rolling group UG1, STZG, UG2 through the transverse conveying unit QT1 or, in the second case, to the compact rolling group UG1, STZG, UG2 through the transverse conveying unit QT2, as also illustrated by the two pass sequence diagrams shown adjacent the two transverse conveying units QT1 and QT2.

While specific embodiments of the invention have been shown and described in detail to illustrate the inventive principles, it will be understood that the invention may be embodied otherwise without departing from such principles.

We claim:

1. A method of operating a roll stand arrangement which includes at least one roughing stand, a compact rolling group arranged downstream of and transversely offset relative to the at least one roughing stand, the compact rolling group including first and second roll stands and an intermediate upsetting stand between the first and second roll stands, a first transverse conveying unit for transversely conveying rolling stock from the at least one roughing stand to a first entry side of the compact rolling group, a connecting roller conveyor arranged between the at least one roughing stand and the first transverse conveying unit, an extension of the connecting roller conveyor extending parallel past the compact rolling group, and a second transverse conveying unit arranged downstream of the extension for transversely conveying rolling stock from the extension to a second entry side of the compact rolling group, the method comprising supplying the rolling stock produced in a continuous casting plant to the roll stand arrangement, and, depending on an even number or odd number of passes required by a predetermined rolling schedule, selectively conveying the rolling stock into one of the first entry side and the second entry side of the compact rolling group.

2. A roll stand arrangement comprising at least one roughing stand, a compact rolling group arranged downstream of and transversely offset relative to the at least one roughing stand, the compact rolling group including first and second roll stands and an intermediate upsetting stand between the first and second roll stands, a first transverse conveying unit for transversely conveying rolling stock from the at least one roughing stand to a first entry side of the compact rolling group, a connecting roller conveyor arranged between the at least one roughing stand and the first transverse conveying unit, an extension of the connecting roller conveyor extending parallel past the compact rolling group, and a second transverse conveying unit arranged downstream of the extension for transversely conveying rolling stock from the extension to a second entry side of the compact rolling group.

3. The roll stand arrangement according to claim 2, wherein the roll stands of the compact rolling group are universal stands.

4. The roll stand arrangement according to claim 2, wherein the roll stands of the compact rolling group are two-high stands.

5. The roll stand arrangement according to claim 2, comprising an intermediate storage means for the rolling stock arranged upstream of the at least one roughing stand.

* * * * *